US008648269B2

(12) United States Patent
Steele et al.

(10) Patent No.: US 8,648,269 B2
(45) Date of Patent: Feb. 11, 2014

(54) KEYLESS SOLENOID RELEASE UNIT

(75) Inventors: John T. Steele, Washington, PA (US); Nathan R. Riemer, Cabot, PA (US); Matthew A. Balmer, Beaver Falls, PA (US)

(73) Assignee: Mitsubishi Electric Power Products, Inc., Warrendale, PA (US)

( * ) Notice: Subject to any disclaimer, the term of this patent is extended or adjusted under 35 U.S.C. 154(b) by 483 days.

(21) Appl. No.: 12/906,811

(22) Filed: Oct. 18, 2010

(65) Prior Publication Data

US 2011/0228509 A1 Sep. 22, 2011

Related U.S. Application Data

(60) Provisional application No. 61/314,898, filed on Mar. 17, 2010.

(51) Int. Cl.
*H01R 9/28* (2006.01)
*H01H 9/28* (2006.01)

(52) U.S. Cl.
USPC ..... 200/43.01; 200/43.11; 200/43.15

(58) Field of Classification Search
USPC ..... 200/43.01, 43.11, 43.15
See application file for complete search history.

(56) References Cited

U.S. PATENT DOCUMENTS

| | | | | |
|---|---|---|---|---|
| 2,580,338 | A * | 12/1951 | Wallace et al. | 200/5 R |
| 3,569,908 | A | 3/1971 | Appleton | |
| 3,795,417 | A | 3/1974 | Cohen | |
| 3,897,093 | A | 7/1975 | Wiczer et al. | |
| 3,917,330 | A | 11/1975 | Quantz | |
| 4,430,685 | A | 2/1984 | Ellsberg | |
| 4,710,739 | A | 12/1987 | Heyne et al. | |
| 4,819,379 | A | 4/1989 | Kenzelmann et al. | |
| 7,215,228 | B2 | 5/2007 | Rhein | |

* cited by examiner

*Primary Examiner* — Ramon Barrera
(74) *Attorney, Agent, or Firm* — Kenneth S. Roberts; One LLP

(57) ABSTRACT

A electrically operated blocking device used to block the operation of electrical or mechanical equipment without using a system of deadbolt locks, keys, and electrically operated key traps. The electrically operated blocking device preferably includes a blocking shaft used to block the operation of electrical equipment such as, e.g., switches, circuit breakers and other similar electrical equipment, or mechanical equipment such as, e.g., valves, cams, gears, doors or any moving device or device operator, and preferably includes a keyless solenoid release unit (KSRU) used to control a plunger that locks the blocking shaft into place and unlocks the blocking shaft to allow the blocking shaft to move freely along its axis.

18 Claims, 3 Drawing Sheets

KEYLESS SOLENOID RELEASE UNIT

FIELD

This application claims the benefit of provisional application Ser. No. 61/314898 filed Mar. 17, 2010, which is fully incorporated herein by reference.

BACKGROUND

When designing electrical equipment, it is sometimes necessary to block the operation of devices such as switches, circuit breakers or other equipment. Such blocking devices prohibit the switch, circuit breaker, or other equipment from being operated by blocking the handle of the switch, circuit breaker or other electrical equipment. The blocking devices are electrically interlocked to external electrical pilot devices such as switches, pushbuttons, relays, and the like.

Current technology, which uses a complicated system of deadbolt locks, keys, and electrically operated key traps, tends to be expensive, bulky and labor intensive to install and use.

It is desirable to provide a blocking device that eliminates the need for deadbolt locks, keys and electrically operated key traps, and reduces the complexity of the installation, is more compact than current technology, and reduces overall costs.

SUMMARY

Embodiments provided herein are directed to an electrically operated blocking device used to block the operation of electrical or mechanical equipment without using a system of deadbolt locks, keys, and electrically operated key traps. The electrically operated blocking device preferably includes a blocking shaft used to block the operation of electrical equipment such as, e.g., switches, circuit breakers and other similar electrical equipment, or mechanical equipment such as, e.g., valves, cams, gears, doors or any moving device or device operator, and preferably includes a keyless solenoid release unit (KSRU) used to control a plunger that locks the blocking shaft into place.

Other systems, methods, features and advantages of the example embodiments will be or will become apparent to one with skill in the art upon examination of the following figures and detailed description.

BRIEF DESCRIPTION OF FIGURES

The details of the example embodiments, including structure and operation, may be gleaned in part by study of the accompanying figures, in which like reference numerals refer to like parts. The components in the figures are not necessarily to scale, emphasis instead being placed upon illustrating the principles of the invention. Moreover, all illustrations are intended to convey concepts, where relative sizes, shapes and other detailed attributes may be illustrated schematically rather than literally or precisely.

It should be noted that elements of similar structures or functions are generally represented by like reference numerals for illustrative purpose throughout the figures. It should also be noted that the figures are only intended to facilitate the description of the preferred embodiments.

DESCRIPTION

Each of the additional features and teachings disclosed below can be utilized separately or in conjunction with other features and teachings to produce an electrically operated blocking device used to block the operation of electrical or mechanical equipment without using a system of deadbolt locks, keys, or electrically operated key traps. Representative examples of the present invention, which examples utilize many of these additional features and teachings both separately and in combination, will now be described in further detail with reference to the attached drawings. This detailed description is merely intended to teach a person of skill in the art further details for practicing preferred aspects of the present teachings and is not intended to limit the scope of the invention. Therefore, combinations of features and steps disclosed in the following detail description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

Figure 1:
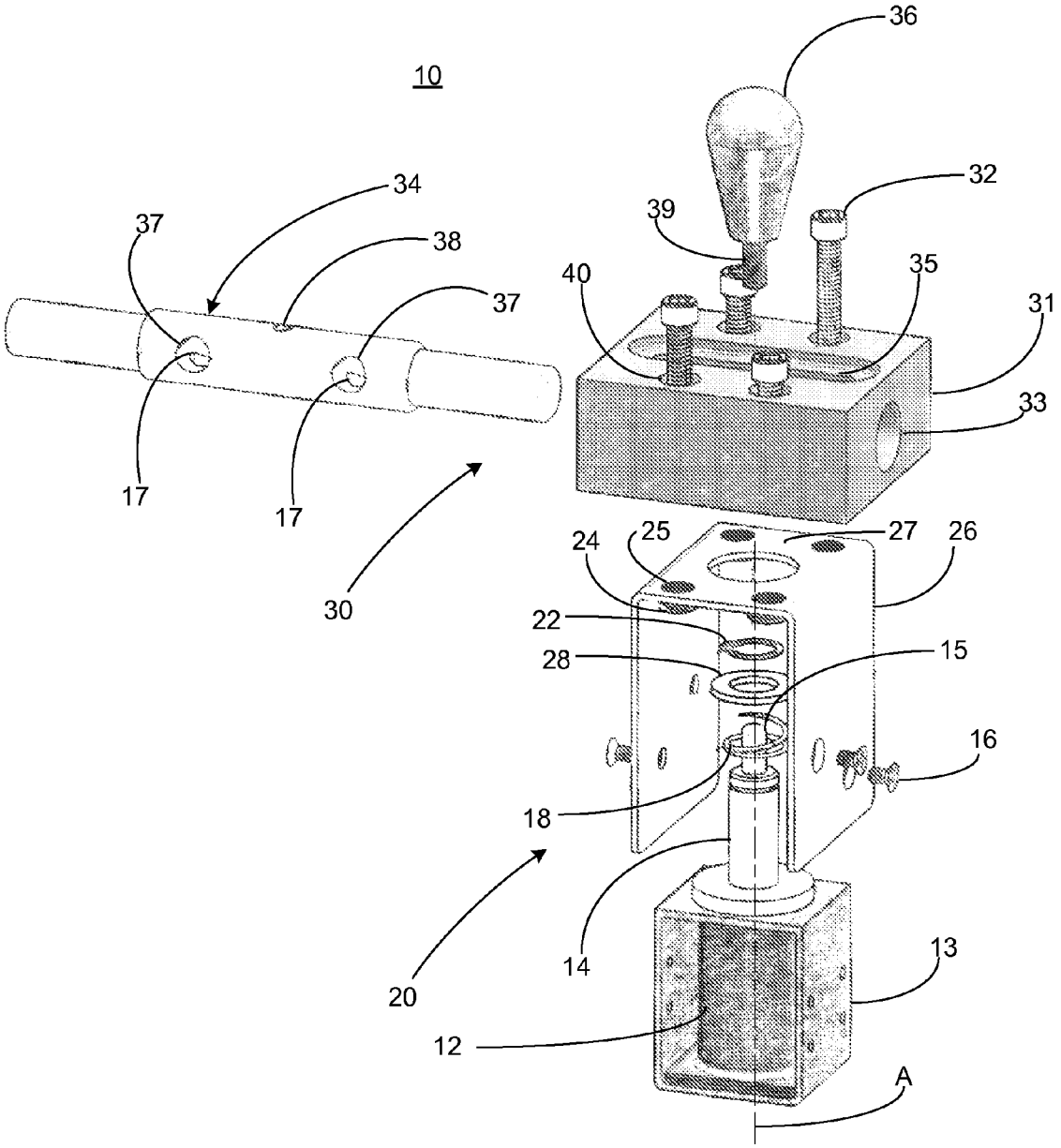
FIG. 1 is an exploded perspective view of the electrically operated blocking device.

Improved systems and methods are provided herein for an electrically operated blocking device used to block the operation of electrical or mechanical equipment that facilitates field installation, while reducing the complexity of the installation procedures and overall costs. Referring in detail to the figures, a preferred embodiment of the an electrically operated blocking device is described. FIG. 1 depicts an electrically operated blocking device 10 having a locking shaft assembly 30 and a keyless solenoid release unit (KSRU) 20. The components of the KSRU 20 include a torroidal shaped solenoid 12 having a housing 13 that is mounted to a solenoid mounting bracket 26 using threaded fasteners 16. The solenoid 12 is preferably mounted such that the axis A of the torrid is oriented vertically. A plunger 14 is inserted into the solenoid 12 along the axis A of the torrid. A spring 18 is attached to the plunger 14 using first and second annulus shaped retaining devices 28 and 22. The spring assembly 18, 28, 22 is used to prevent the plunger from dropping into the solenoid 12, that is, the spring assembly 18, 28, 22 keeps the plunger 14 in the extended position. Threaded nuts 24 are mounted into openings 25 in a top panel 27 of the mounting bracket 26.

The components of the locking shaft assembly 30 include a shaft-guide 31 secured to the top panel 27 of the mounting bracket 26 using threaded fasteners 32 that extend through through-holes 40 formed in the shaft-guide 31 and are sized to mate with the threaded nuts 24 mounted in the openings 25 in the top panel 27 of the mounting bracket 26. A shaft 34 is slidably inserted into a guide-hole 33 formed in the shaft-guide 31. The blocking shaft 34 includes a plurality of through holes 37 formed in a central portion of the blocking shaft 34. In addition, the blocking shaft 34 has two chamfered holes 17. The chamfers of the holes 17 are used to guide the locking pin 15 into the holes 17. The chamfered holes 17 are preferable positioned on a vertical axis below the centerline of the through holes 37. The upper bore of the chamfered holes 17 is visible in the through holes 37 in the blocking shaft detail 34 shown in FIG. 1.

In one embodiment, the blocking device 10 can accept a hasp style lock engaging one of the through holes 37 drilled through the blocking shaft 34 to lock the blocking device 10 into position preventing the blocking device 10 from being operated.

An operator handle 36 includes a threaded shaft 39 that extends through a slot 35 formed in the shaft guide 31 and is received in a threaded hole 38 formed in the shaft 34 at its longitudinal center. The operator handle 36 is used to slide the shaft 34 along its axis so that the operation of a device to which it is coupled can be blocked.

Figure 2:
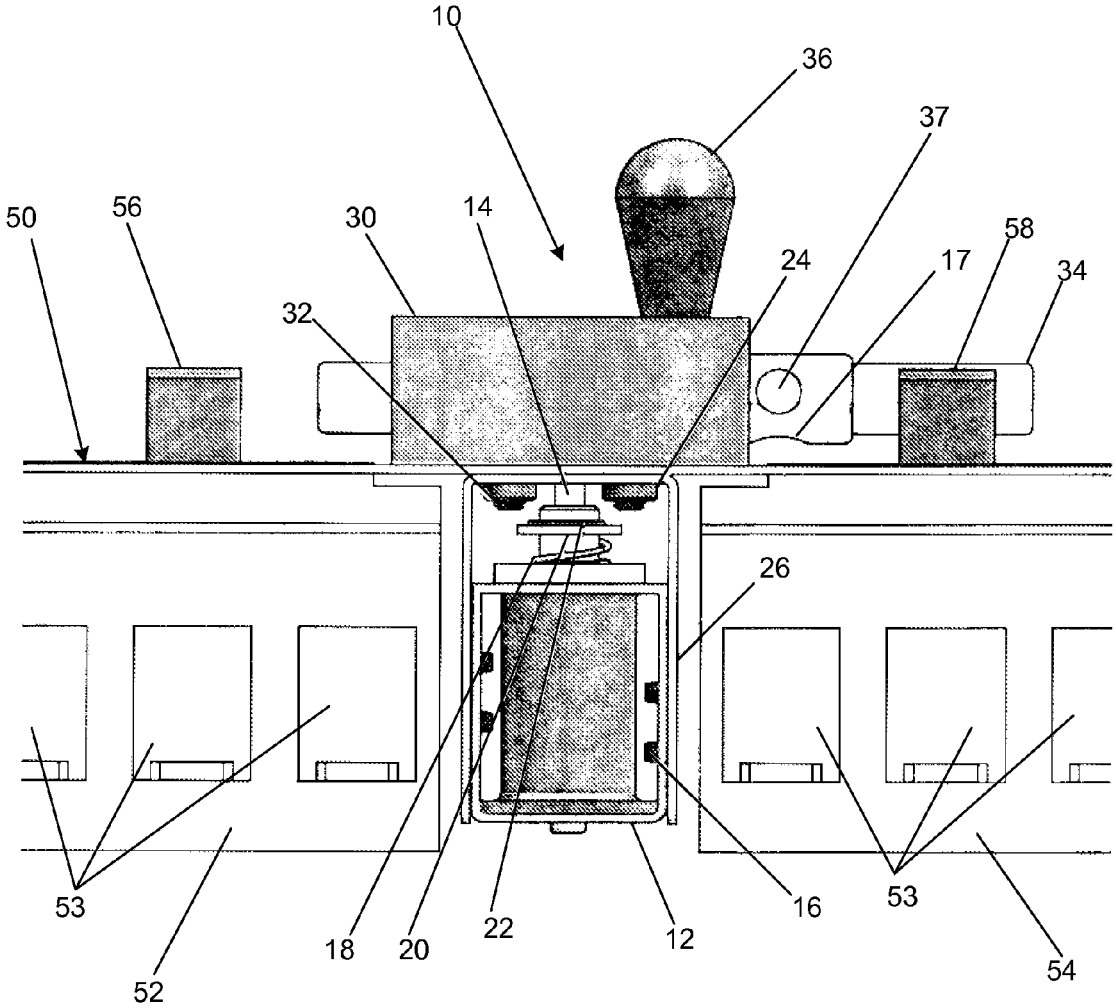
FIG. 2 is an elevation view of the electrically operated blocking device mounted on an electrical panel.
Figure 3:
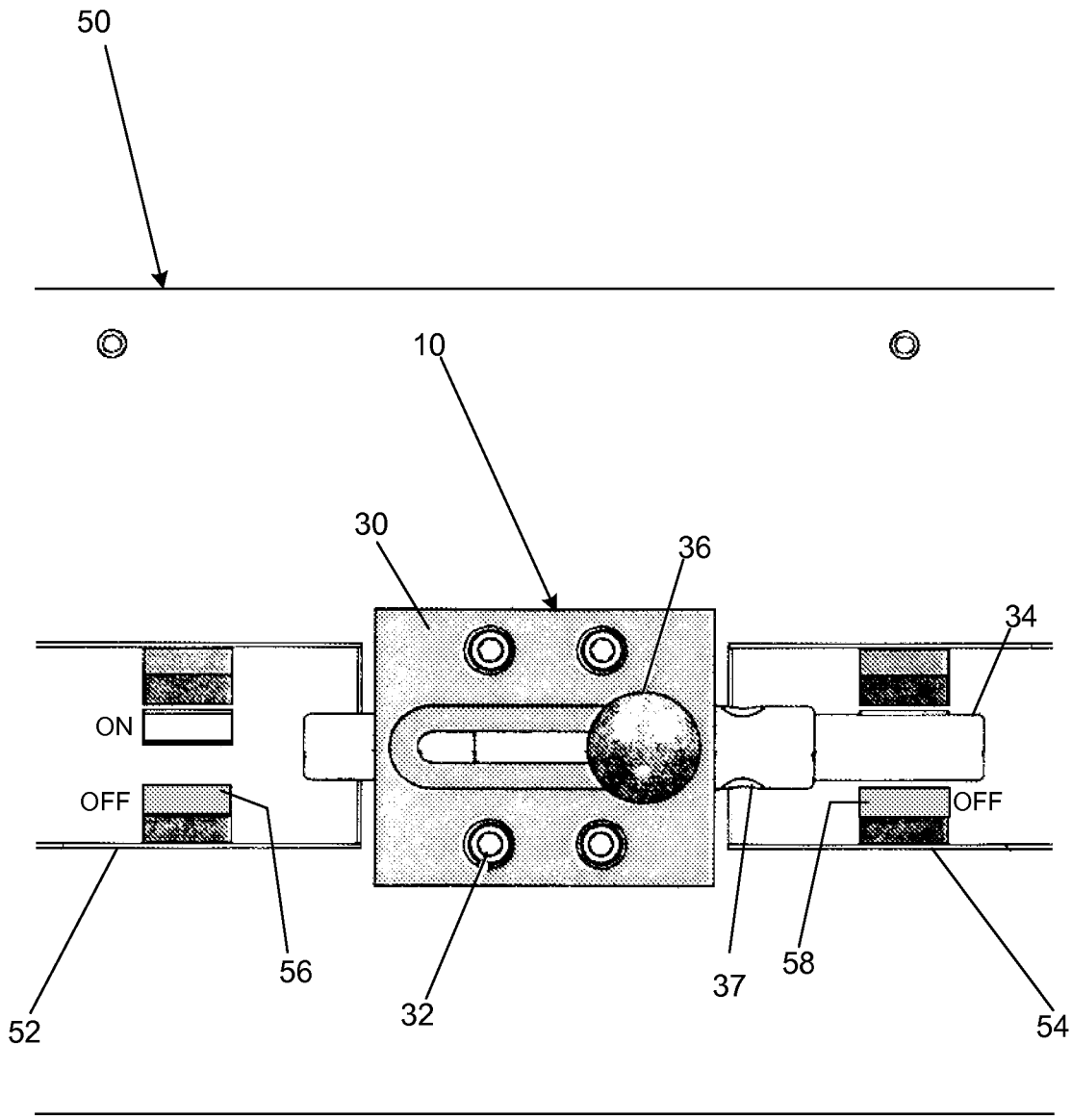
FIG. 3 is a top plan view of the electrically operated blocking device mounted on an electrical panel.

For example purposes only, FIGS. 2 and 3 depict the electrically operated blocking device 10 mounted on an electrical panel enclosure 50 that is equipped with two electrical devices 52 and 54, e.g., circuit breakers that include a plurality of terminal blocks 53 to which wiring can be coupled. The electrical devices 52 and 54 include switch handles 56 and 58 which are movable, when unimpeded, between an "OFF" position and an "ON" position The KSRU 20 is preferably pre-assembled for installation and is installed on the interior of the panel 50. In this example, the KSRU 20 is installed between the two electrical devices 52 and 54 that are to be blocked. The shaft guide 31 of the blocking shaft assembly 30 is installed on the exterior of the electrical panel 50. The threaded fasteners 32 are inserted in the shaft guide 31 through the through-holes 40 bored perpendicular to the axis of the guide-hole 33 in the shaft guide 31. The threaded fasteners 32 are designed to interlock with the threaded nuts 24 mounted to the solenoid mounting bracket 26. The threaded fasteners 32 are torqued to secure the KRSU 20 and shaft guide 31 to the electrical enclosure 50.

To install the blocking shaft 34, the plunger 14 is retracted and the blocking shaft 34 is inserted into the guide-hole 33 in the shaft-guide 31. Once the blocking shaft 34 is inserted, the plunger item 14 is released. The operator handle 36, with its threaded shaft 39 inserted into the blocking shaft 34, is used to move the blocking shaft 34 until the locking pin 15 of the plunger 14 sets into one of the plurality of chamfered holes 17 in the blocking shaft 34 locking the blocking shaft 34 into a neutral or blocking position.

As depicted in FIGS. 2 and 3, the right electrical device 54 is shown being blocked from operating by the blocking shaft 34, i.e., the blocking shaft 34 is in a blocking position such that the switch handle 58 of the electrical device 54 is blocked from moving from the "OFF" to the "ON" position by the blocking shaft 34.

Referring to FIG. 2, the spring force created by the spring 18 forces the locking pin 15 at the end of the plunger 14 into one of the chamfered holes 17 in the blocking shaft 34. The interface between the plunger 14 and the chamfered hole 17 in the blocking shaft 34 locks the blocking shaft 34 into position. In order to move the shaft 34, an electrical pilot device electrically coupled to the solenoid 12 is used to introduce a voltage to the solenoid 12. The voltage creates a magneto-motive force along the axis A of the solenoid 12. The magneto-motive force overcomes the spring force created by the spring 18 causing the plunger 14 to move down along the axis A of the solenoid 12. The locking pin 15 at the end of the plunger 14 exits the chamfered hole 17 in the blocking shaft 34 allowing the blocking shaft 34 to move freely using the operator handle item 36.

As one skilled in the art would readily recognize, the electrically operated blocking device 10 can be used to block a switch handle or other actuator of any number of devices and, thus, block such devices from being operated.

In an experiment, a prototype of an embodiment of the blocking device 10 described herein was installed on a circuit breaker panel with two circuit breakers similar to the circuit breaker panel 50 described herein. The blocking device 10 was used to control the operating sequence of two circuit breakers. The pilot device coupled to the blocking device 10 was a momentary pushbutton used to simulate a signal from a remote pilot device. The right circuit breaker 54 was locked in the blocking position by the locking pin 15 on the end of the plunger 14 of the KSRU 20. The momentary pushbutton was pressed impressing a voltage on the electrical terminals of the solenoid 12. The plunger 14 retracted and the shaft 34 was moved to the left unblocking the switch handle 58 of the circuit breaker 54.

In other embodiments, the KSRU 20 may include appurtenances, such as electrical switches and mechanical devices, that can be connected to the KSRU 20 to provide feedback signals to other equipment.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

The invention claimed is:

1. An electrically operated blocking device for blocking the operation of electrical or mechanical device, comprising a blocking shaft operably couplable to a device to block the operation of the device, a keyless solenoid release unit releasably couplable to the blocking shaft to releasable lock the blocking shaft in a blocking position, a shaft guide slidably receiving the blocking shaft and couplable to the release unit, and a plurality of holes formed in the blocking shaft and releasably engageable by the release unit to lock the blocking shaft in a plurality of positions along a longitudinal axis of the blocking shaft.

2. The blocking device of claim 1 wherein the release unit includes a solenoid and a plunger operably coupled to the solenoid, wherein the plunger is moveable along the axis of the solenoid.

3. The blocking device of claim 2 wherein the solenoid is toroidal in shape.

4. The blocking device of claim 3 further comprising a locking pin extending coaxially from a first end of the plunger, wherein the second end of the plunger is positioned within the solenoid, wherein the locking pin is releasably receivable within the plurality of holes in the blocking shaft.

5. The blocking device of claim 4 further comprising a spring operably coupled to the plunger.

6. The blocking device of claim 5 further comprising first and second annulus shaped retaining devices, wherein the first retaining device is coupled to a first and of the spring, the second of the spring being coupled to the solenoid, and wherein the second retaining device is coupled to the plunger, wherein the spring and first retaining device interpose the second retaining device and solenoid.

7. The blocking device of claim 2 wherein the solenoid is electrically interlocked to an external electrical pilot device.

8. The blocking device of claim 7 wherein the solenoid generates a magneto-motive force along its axis causing the plunger to move axially upon the introduction of a voltage to the solenoid by the electrical pilot device.

9. The blocking device of claim 7 wherein the blocking shaft can be locked into position.

10. An electrical device and operation blocking mechanism, comprising an electrical enclosure, a switch handle extending from the enclosure, the switch handle being moveable between first and second positions, wherein the electrical device is in an off mode when the switch handle is in the first position and in an on mode when the switch handle is in the second position, a blocking mechanism coupled to the enclosure and comprising a blocking shaft operably couplable with the switch handle to prevent movement of the switch handle, a keyless solenoid release unit releasably couplable to the blocking shaft to releasable lock the blocking shaft in a blocking position, a shaft guide slidably receiving the blocking shaft and couplable to the release unit, and a plurality of holes formed in the blocking shaft and releasably engageable by the release unit to lock the blocking shaft in a plurality of positions along a longitudinal axis of the blocking shaft.

11. The electrical device of claim 10 wherein the release unit includes a solenoid and a plunger operably coupled to the solenoid, wherein the plunger is moveable along the axis of the solenoid.

12. The electrical device of claim 11 wherein the solenoid is toroidal in shape.

13. The electrical device of claim 12 further comprising a locking pin extending coaxially from a first end of the plunger, wherein the second end of the plunger is positioned within the solenoid, wherein the locking pin is releasably receivable within the plurality of holes in the blocking shaft.

14. The electrical device of claim 13 further comprising a spring operably coupled to the plunger.

15. The electrical device of claim 14 further comprising first and second annulus shaped retaining devices, wherein the first retaining device is coupled to a first and of the spring, the second of the spring being coupled to the solenoid, and wherein the second retaining device is coupled to the plunger, wherein the spring and first retaining device interpose the second retaining device and solenoid.

16. The electrical device of claim 11 wherein the solenoid is electrically interlocked to an external electrical pilot device.

17. The electrical device of claim 16 wherein the solenoid generates a magneto-motive force along its axis causing the plunger to move axially upon the introduction of a voltage to the solenoid by the electrical pilot device.

18. The electrical device of claim 16 wherein the blocking shaft can be locked into position.

* * * * *